US009939174B2

(12) United States Patent
Rodriguez et al.

(10) Patent No.: US 9,939,174 B2
(45) Date of Patent: Apr. 10, 2018

(54) TEMPERATURE AND PRESSURE RELIEF VALVE WITH OIL-IMMERSED MECHANISM

(71) Applicants: Otto Rodriguez, Miami, FL (US); Juan A Lopez, Fayetteville, GA (US)

(72) Inventors: Otto Rodriguez, Miami, FL (US); Juan A Lopez, Fayetteville, GA (US)

(73) Assignees: Otto Rodriguez, Miami, FL (US); Jaun A Lopez, Fayetteville, GA (US)

( * ) Notice: Subject to any disclaimer, the term of this patent is extended or adjusted under 35 U.S.C. 154(b) by 0 days.

(21) Appl. No.: 15/220,559

(22) Filed: Jul. 27, 2016

(65) Prior Publication Data

US 2017/0115032 A1 Apr. 27, 2017

Related U.S. Application Data

(60) Provisional application No. 62/244,900, filed on Oct. 22, 2015.

(51) Int. Cl.
*F24H 9/20* (2006.01)

(52) U.S. Cl.
CPC ..... *F24H 9/2007* (2013.01)

(58) Field of Classification Search
CPC ..... F24H 9/2007
USPC ..... 122/14.3
See application file for complete search history.

(56) References Cited

U.S. PATENT DOCUMENTS 1,694,492 A * 12/1928 Tabler ..... F22B 37/42 122/504
1,941,023 A * 12/1933 Smith ..... F16K 17/003 122/14.1
2,210,555 A 8/1940 Podolsky
2,570,432 A * 10/1951 Dillon ..... F16K 17/003 137/540
2,810,527 A * 10/1957 Work ..... F16K 17/003 236/80 R
3,366,128 A * 1/1968 Feinberg ..... F16K 17/003 137/315.04
3,662,949 A * 5/1972 McIntosh ..... F16K 17/38 137/522
3,873,808 A * 3/1975 Patton ..... H05B 1/0216 219/491
4,601,457 A * 7/1986 Austin ..... F16K 31/1225 251/63
4,827,962 A 5/1989 Picton
5,071,066 A * 12/1991 Willson ..... F16K 17/003 137/542
5,893,521 A * 4/1999 Bertain ..... B05B 1/14 137/312
6,553,946 B1 * 4/2003 Abraham ..... F24H 9/2035 122/14.22

(Continued)

OTHER PUBLICATIONS

Daniel Measurement and Control, DAN-LIQ-TG-Surge Relief-04-07, Apr. 2007.

*Primary Examiner* — Nathaniel Herzfeld

(74) *Attorney, Agent, or Firm* — Mark Malek; Paul Ditmyer; Widerman Malek, PL

(57) ABSTRACT

Water heater relief valves intended to safeguard against overpressure and overtemperature emergencies are frequently rendered inoperative by corrosion or calcification. These problems are ameliorated by enclosing all or part of the valve mechanism in a sealed chamber containing a corrosion inhibiting medium, which may be an oil.

12 Claims, 3 Drawing Sheets

(56) References Cited

U.S. PATENT DOCUMENTS

| | | | | |
|---|---|---|---|---|
| 2008/0115742 | A1* | 5/2008 | Jackson | F24D 19/083 122/504 |
| 2010/0200783 | A1* | 8/2010 | Lamb | F16K 31/002 251/11 |
| 2015/0034171 | A1* | 2/2015 | Morris | F16K 17/048 137/15.17 |
| 2015/0219242 | A1 | 8/2015 | Almazan et al. | |

* cited by examiner

TEMPERATURE AND PRESSURE RELIEF VALVE WITH OIL-IMMERSED MECHANISM

BACKGROUND INFORMATION

A tank-type liquid heater (e.g., a residential water heater) is conventionally equipped with a relief valve assembly that protects against excessive pressure and excessive temperature. Wetted portions of these relief valves are subject to corrosion and calcification, either of which can render the valve inoperative and unable to prevent a tank from bursting or exploding and sometimes starting a fire. Such fires and explosions cause several hundred million dollars of structural damage and dozens of deaths and injuries each year in the United States and worldwide.

Overpressure protection is commonly supplied by means of a poppet valve in which a coil spring acts on an axially translatable shaft to bias a moveable member (e.g., a valve disk) against a seat. The poppet coil spring strength and the disk size are commonly selected so that the valve opens and vents water when pressure in the tank exceeds 150 psi, which is below a burst pressure of the tank. This valve is subject to corrosion and calcification because one side of the disk is exposed to the inside of the tank during normal operation and both the other side of the disk and the poppet spring are exposed to water when the valve relieves overpressure, is manually opened for test purposes, or is improperly installed to provide upwardly directed outflow.

Attempts to deal with the deleterious effects of corrosion and calcification have commonly resulted in a requirement for regular (generally annual) manual test operation of an overpressure valve and scheduled (e.g., triennial) replacement of that valve. Both of these safety practices are commonly ignored by the consumer, resulting in catastrophic property damages and injuries.

If the heater does not have a functioning inlet check valve a runaway heater element may cause dangerous excess temperature not accompanied by excess pressure. Overtemperature protection is commonly supplied independently of overpressure protection by means of a wax motor temperature sensor/actuator comprising a protruding plunger or stroke rod portion that pushes against the wetted side of the poppet valve disk when the wax is heated and expands. The temperature sensor/actuator is wetted by the water in the tank and is subject to corrosion, calcification and mineral deposits.

BRIEF SUMMARY OF THE INVENTION

One aspect of the invention is that it provides a pressure relief valve comprising an oil-immersed poppet valve mechanism which may comprise a coil poppet spring and an axially translatable shaft that is sealed by means of O-rings into an oil-filled spring chamber. In preferred embodiments the poppet mechanism is operable without exposing the poppet valve spring to water and to whatever minerals may be in that water.

Another aspect of the invention is that it provides a temperature relief valve comprising a temperature sensor/actuator that is at least partially, and may be entirely, immersed in a corrosion-inhibiting fluid, such as an oil, so as to minimize exposure of the actuator body and its protruding plunger to contaminants in the water.

Yet another aspect of the invention is that it provides a temperature and pressure relief valve for a liquid heating apparatus, the valve comprising oil-immersed components protecting against both overpressure and overtemperature.

Those skilled in the art will recognize that the foregoing broad summary description is not intended to list all of the features and advantages of the invention which generally comprises a valve mechanism immersed in oil that isolates and lubricates the mechanism to maintain it throughout its expected service life. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

Figure 1:
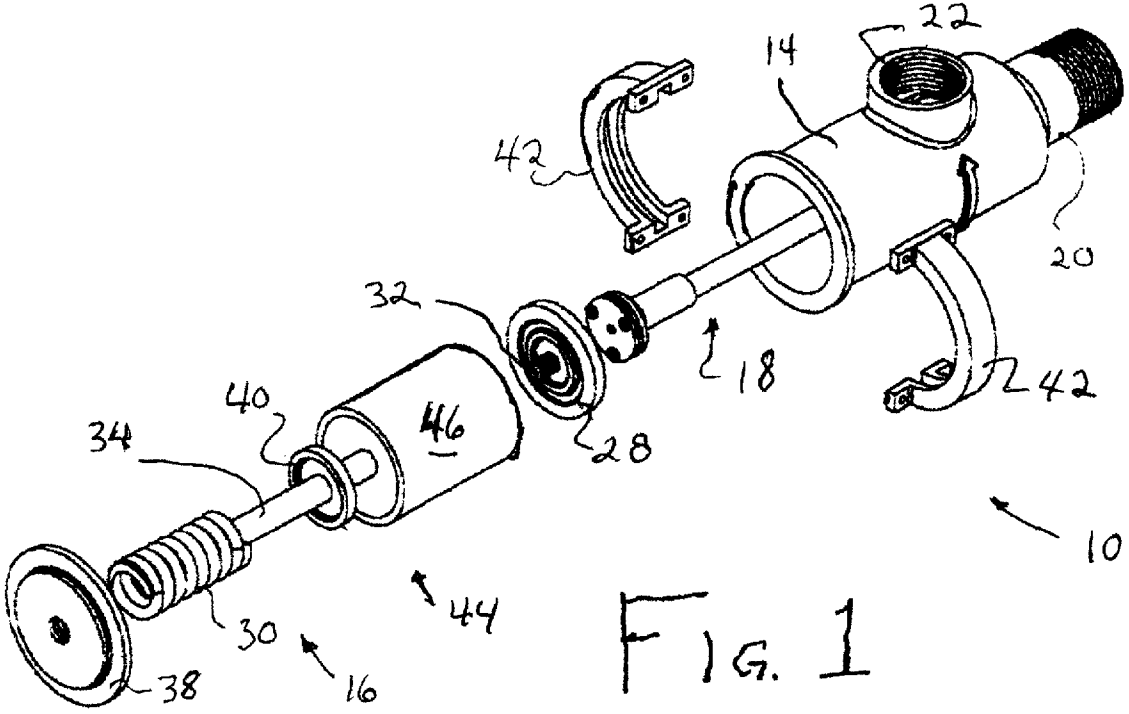
FIG. 1 is an exploded perspective view of a preferred overpressure and overtemperature relief valve of the invention.
Figure 3:
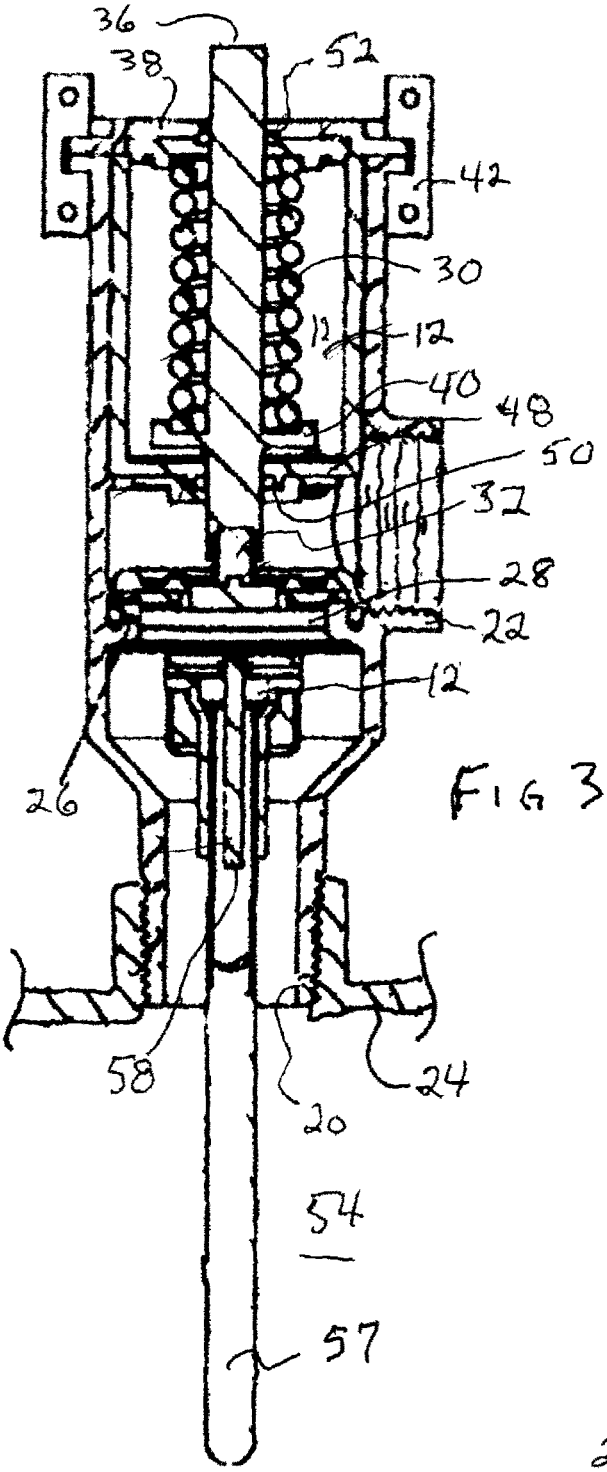
FIG. 3 is an axial cross-sectional view of an assembled valve of FIG. 1.
Figure 2:
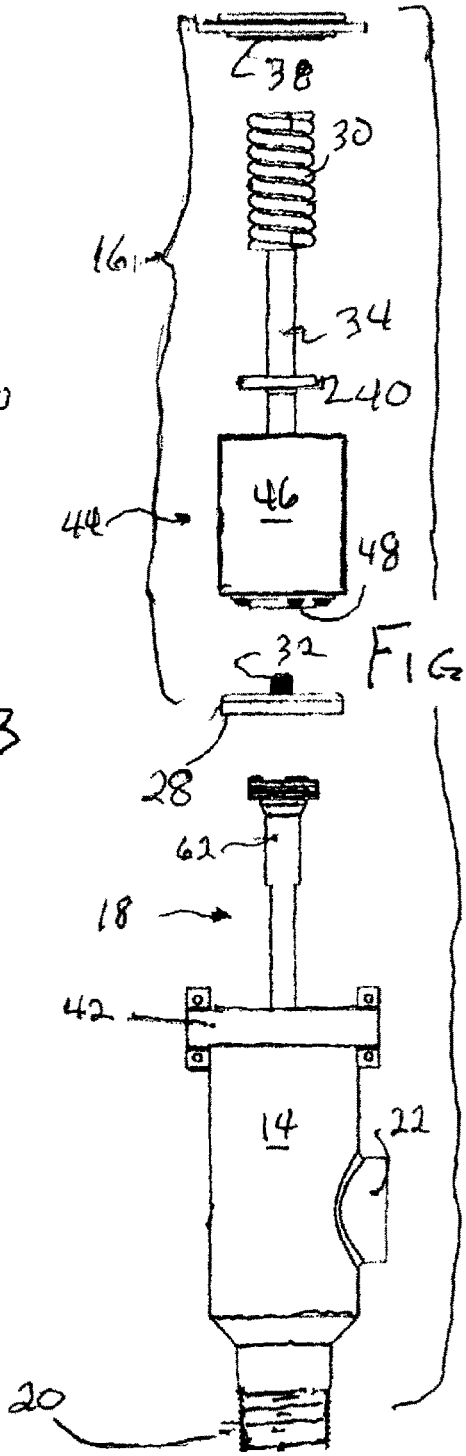
FIG. 2 is an exploded side view of a partially assembled valve of FIG. 1.
Figure 4:
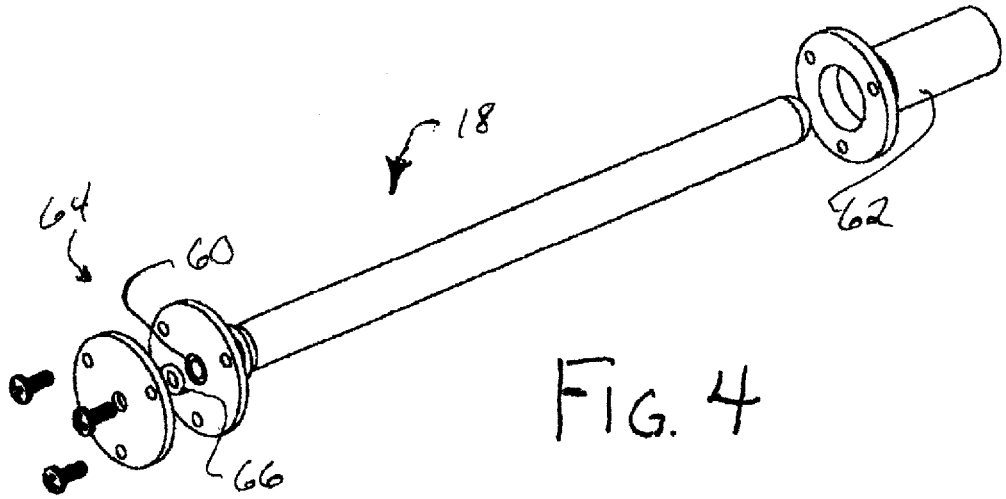
FIG. 4 is an exploded perspective view of an overtemperature sensor/actuator of the invention showing a protruding plunger and its associated oil chamber.
Figure 5:
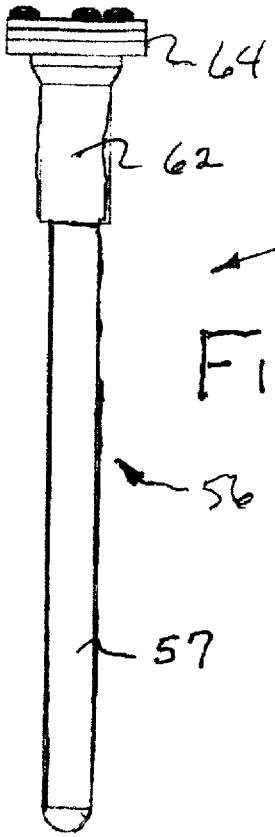
FIG. 5 is a side view of an assembled overtemperature sensor/actuator of FIG. 4.

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

The invention teaches, inter alia, protecting moving parts of a relief valve 10 from corrosion by sealing them in appropriate chambers, which may be wholly or partially filled with a corrosion-inhibiting medium 12, such as a selected oil, grease, alcohol, dry air, etc. The skilled reader will understand that that no limitation to a particular fill medium is intended.

A preferred relief valve 10 comprises a valve body 14 holding both a poppet valve assembly 16 and a temperature sensor/actuator 18. The valve body 14 may comprise conventional threaded inlet 20 and outlet 22 ports for respective attachment to a pressure vessel, such as a water heater tank 24 and to a drain line (not shown). A preferred valve body 14 comprises an integrally formed valve seat 26 against which a moveable member 28, i.e., a poppet valve disk, is biased by a poppet spring 30. Those skilled in the art will recognize that other arrangements (e.g., providing a separate seat member threadably coupled to a valve body) could be used.

A preferred poppet valve head or disk 28 is fixedly connected (e.g., by a screw 32) to an axially moveable shaft 34 long enough so that an end 36 distal from the head 28 extends outwardly from an end cap 38 when the valve is assembled. This arrangement allows for connection of the distal end to an external test lever (not shown, but common in prior art valves) that can be pivoted to overcome the poppet spring bias and lift the poppet valve head off the seat for a manual test of the valve.

In the preferred embodiment the valve spring 30 is a coil spring captured between a collar 40 fixed to or integrally formed with the shaft 34, and an end cap 38 or end cap subassembly. The reader will recognize that the use of two half-collars 42 to clamp the end cap to the valve body is a matter of design choice and that many other arrangements can be used to connect the poppet valve mechanism to the valve body.

A preferred embodiment of the invention provides an oil-filled spring chamber 44 for the poppet spring in order to protect encapsulated components from corrosion, calcification or mineral deposits. This chamber may comprise a sleeve 46 extending between two end caps 38, 48, each of which is sealed to the axial shaft 34 by a respective O-ring 50, 52 to permit axial translation of the shaft. The reader will recognize that there are many possible designs for the caps and their attachment to the spring chamber sleeve.

A preferred embodiment of the invention may comprise a temperature sensor/actuator 18 extending outwardly of the valve inlet tube into the water 54 retained in the tank 24. The sensor/actuator may comprise a wax motor 56 having a tubular body member 57 holding a selected quantity of wax and a captive plunger 58. The plunger is arranged to push the poppet valve disk 28 off its seat 26 if the water temperature becomes too high, which causes the wax to expand and drive the plunger 58 outward from the body member 57. In a preferred embodiment an oil-filled wax motor oil chamber 60 is provided by capturing a plunger end of the wax motor between an oil casing 62 and an end cap subassembly 64 comprising an O-ring 66 selected to seal around the plunger 58. The preferred oil casing 62 is sized to fit snuggly about the wax motor body and may be sealed to the motor body by an appropriate adhesive or by recourse to gaskets, O-rings or other sealing mechanisms. An enlarged throat portion may be provided on the oil casing to provide an internal reservoir about the plunger.

Although the preferred oil casing 62 covers only a portion of the wax motor body, one could configure the oil casing to extend over the full length of the wax motor body 57 and to define an oil chamber surrounding the wax motor body.

The reader will understand that the apparatus of the invention can be used with a variety of oils, greases and other materials as long as they provide a non-corrosive, stable environment for the mechanical elements of the apparatus to function. The reader will recognize that one of skill in the art can select an oil optimized for high thermal transfer efficiency and long term stability at the temperatures encountered in water heater service. In some preferred embodiments the protected elements are immersed in an edible oil.

Although the invention has been described with respect to embodiments providing oil-immersion for both a poppet valve subassembly and a temperature sensor/actuator, the reader will recognize that the invention is not so restricted and embraces embodiments providing oil-immersion for only one of these subsystems.

Although the present invention has been described with respect to several preferred embodiments, many modifications and alterations can be made without departing from the invention. Accordingly, it is intended that all such modifications and alterations be considered as being within the spirit and scope of the invention.

The invention claimed is:

1. A temperature and pressure relief valve for use with a water heater tank, the relief valve comprising:

a valve body including a valve seat, an inlet port and an outlet port;

a valve assembly, carried by the valve body, and including a moveable valve head sealingly biased against the valve seat by a valve spring which is sealed within a spring chamber configured to be filled with a first protective fluid, wherein the valve head is configured to be moved off the valve seat against a bias force of the valve spring when a pressure in the water heater tank exceeds a pressure threshold to allow water to flow from the water heater tank via the outlet port, and wherein the spring is protected, by the spring chamber and first protective fluid, from corrosion, calcification and/or mineral deposits which cause lock-up of the valve assembly; and a temperature sensor/actuator, carried by the valve body and including an elongated plunger body having a lower end configured to extend out of the inlet port and into the water held in the water heater tank, and including a captive plunger extending out of an upper end of the elongated plunger body, opposite the lower end, and configured to push the valve head off the valve seat when a temperature of the water exceeds a temperature threshold;

wherein the upper end of the elongated plunger body includes a plunger casing, encasing the upper end and sealing around the captive plunger, and configured to be filled with a second protective fluid to protect the upper end and captive plunger from corrosion, calcification and/or mineral deposits which cause lock-up of the temperature sensor/actuator.

2. The temperature and pressure relief valve according to claim 1 wherein the first and second protective fluids comprise high temperature resistant oil or grease.

3. The temperature and pressure relief valve according to claim 1 wherein the valve assembly comprises a shaft that mounts the moveable valve head, spring chamber and valve spring.

4. The temperature and pressure relief valve according to claim 3 wherein the valve spring comprises a coil spring surrounding the shaft.

5. The temperature and pressure relief valve according to claim 1 wherein the temperature sensor/actuator comprises a wax motor.

6. A water heater comprising:

a tank configured to hold water and including an outlet; and a temperature and pressure relief valve connected to the outlet of the tank, the relief valve comprising:

a valve body including a valve seat, an inlet port and an outlet port, a valve assembly, carried by the valve body, and including a moveable valve head sealingly biased against the valve seat by a valve spring which is sealed within a spring chamber configured to be filled with a first protective fluid, wherein the valve head is configured to be moved off the valve seat against a bias force of the valve spring when a pressure in the water heater tank exceeds a pressure threshold to allow water to flow from the water heater tank via the outlet port and outlet of the tank, and wherein the spring is protected, by the spring chamber and first protective fluid, from corrosion, calcification and/or mineral deposits which cause lock-up of the valve assembly, and a temperature sensor/actuator, carried by the valve body and including an elongated plunger body having a lower end configured to extend out of the inlet port and into the water held in the water heater tank, and including a captive plunger extending out of an upper end of the elongated plunger body, opposite the lower end, and configured to push the valve head off the valve seat when a temperature of the water exceeds a temperature threshold, wherein the upper end of the elongated plunger body includes a plunger casing, encasing the upper end and sealing around the captive plunger, and configured to be filled with a second protective fluid to protect the upper end and captive plunger from corrosion, calcification and/or mineral deposits which cause lock-up of the temperature sensor/actuator.

7. The water heater according to claim 6, wherein the first and second protective fluids comprise high temperature resistant oil or grease.

8. The water heater according to claim 6 wherein the valve assembly comprises a shaft that mounts the moveable valve head, spring chamber and valve spring.

9. The water heater according to claim 8 wherein the valve spring comprises a coil spring surrounding the shaft.

10. The water heater according to claim 6 wherein the temperature sensor/actuator comprises a wax motor.

11. A temperature and pressure relief valve for use with a water heater tank, the relief valve comprising:

a valve body including a valve seat, an inlet port and an outlet port;

a valve assembly, carried by the valve body, and including a shaft that mounts a moveable valve head sealingly biased against the valve seat by a valve spring which is sealed within a spring chamber filled with a protective oil, wherein the valve head is configured to be moved off the valve seat against a bias force of the valve spring when a pressure in the water heater tank exceeds a pressure threshold to allow water to flow from the water heater tank via the outlet port, and wherein the valve spring is protected, by the spring chamber and protective oil, from corrosion, calcification and/or mineral deposits which cause lock-up of the valve assembly; and a wax motor carried by the valve body and having a lower end configured to extend out of the inlet port and into the water held in the water heater tank, and including a captive plunger extending out of an upper end of an elongated plunger body, opposite the lower end, and configured to push the valve head off the valve seat when a temperature of the water exceeds a temperature threshold, wherein the upper end of the plunger body includes a plunger casing, encasing the upper end and sealing around the captive plunger, and filled with the protective oil to protect the upper end and captive plunger from corrosion, calcification and/or mineral deposits which cause lock-up of the temperature sensor/actuator.

12. The pressure relief valve according to claim 11 wherein the protective oil comprises a high temperature resistant oil or grease.

* * * * *